US005971725A

United States Patent [19]

de Simon et al.

[11] Patent Number: 5,971,725

[45] Date of Patent: Oct. 26, 1999

[54] VACUUM PUMPING DEVICE

[75] Inventors: Mauro de Simon, Osoppo; Gianfranco Capuzzo, Settimo Torinese, both of Italy

[73] Assignee: Varian, Inc., Palo Alto, Calif.

[21] Appl. No.: 08/958,208

[22] Filed: Oct. 7, 1997

[30] Foreign Application Priority Data

Oct. 8, 1996 [IT] Italy ..... T096 A821

[51] Int. Cl.[6] ..... F04B 35/04

[52] U.S. Cl. ..... 417/423.8; 417/423.1; 417/423.4; 417/423.7

[58] Field of Search ..... 417/423.4, 423.7, 417/423.8, 32, 423.1

[56] References Cited

U.S. PATENT DOCUMENTS 4,722,669 2/1988 Kundert ..... 417/32
5,238,362 8/1993 Casaro et al. ..... 415/90
5,368,446 11/1994 Rode ..... 417/18
5,380,171 1/1995 Nagaoka et al. ..... 417/423.4
5,443,368 8/1995 Weeks et al. ..... 417/27

*Primary Examiner*—Timothy S. Thorpe
*Assistant Examiner*—Ehud Gartenberg
*Attorney, Agent, or Firm*—Bella Fishman; William R. McClellan

[57] ABSTRACT

The invention concerns a vacuum pumping device comprising: a vacuum pump (100) having a casing (101), provided with a suction port (119) and an exhaust port (120), in which there is defined a first portion (102), housing the gas pumping stages formed by rotor disks (113, 114) secured to a pump rotatable shaft (123), and stator rings (115, 116) secured to the vacuum pump casing and cooperating with said rotor disks (113, 114); and a second portion (103) housing the electric motor (121) of the vacuum pump and at least one bearing (122) for supporting the shaft (123); an electronic control unit (1) comprising a housing (2) defining an inner space (17) containing the electronic components of an electronic circuit feeding the electric motor (121), and wherein at least the second portion (103) of the pump casing (101) is located within the inner space (17) containing the electronic components.

21 Claims, 15 Drawing Sheets

VACUUM PUMPING DEVICE

BACKGROUND OF THE INVENTION

1. Field of the Invention

The present invention relates to a vacuum pumping device, particularly of the type comprising a turbomolecular pump.

As it is known in the art, a turbomolecular vacuum pump comprises a plurality of pumping stages housed within a substantially cylindrical casing and provided with an axial inlet port of the pumped gases located at one end, and with a radial or axial exhaust port of the gases located at the opposite end of the cylindrical casing.

The pumping stages generally comprise a rotor disk, secured to the rotating shaft of the pump, that is driven by an electric motor at a speed usually not lower than 25,000 rpm and in some cases as high as 100,000 rpm.

The rotor disk rotates within stator rings fastened to the pump casing and defining the stator of the pumping stage, with a very small gap therebetween. In the space between a rotor disk and the associated stator disk a pumping channel of the pumped gases is defined.

The pumping channel defined between the rotor and the stator in each pumping stage communicates with both the preceding and the subsequent pumping stages through a suction port and an exhaust port, respectively, provided through the stator in correspondence with the pumping channel of the pumped gases.

A turbomolecular pump of the above type is disclosed, for example, in the U.S. Pat. No. 5,238,362 assigned to the assignee of the present invention. The turbomolecular pump described in U.S. Pat. No. 5,238,362 employs both pumping stages provided with rotors formed as flat disks and pumping stages provided with rotors equipped with blades. This combined arrangement of pumping stages results in a very good performance of the pump in respect of the compression ratio, while allowing the gases to be discharged into the outer environment at atmospheric pressure by means of simple pre-vacuum pumps without lubricant, such as diaphragm pumps. Moreover the construction of a vacuum pump of the turbomolecular type as taught by the U.S. Pat. No. 5,238,362 allows for a considerable reduction of the pump power consumption.

It has been suggested to employ electronic control units or controllers for feeding the electric motor of a vacuum pump in general, and more particularly of the turbomolecular type, such pumps being equipped with an electronic feeding circuit adapted to generate a voltage system for feeding the electric motor that rotates the vacuum pump.

Generally such control unit comprises means for converting the available AC mains voltage into the rated voltage level suitable for the operation of the vacuum pump motor, and means for adjusting the feeding voltage level during the pump working cycle on the basis of the residual pressure within the vacuum pump and the operating conditions of the pump motor, from the starting condition to the steady state rotating condition.

Because of the overall size and the cooling requirements, the known unit must be mounted separately from the turbomolecular pump and be equipped with dedicated cooling devices in addition to those already provided for cooling the pump.

The provision of a control unit separated from the vacuum pump, to be independently cooled and electrically connected both to the mains and to the vacuum pump by conductors of suitable length and cross-section, is an inconvenience preventing the construction of vacuum pumping devices that are compact and of small size.

2. Summary of the Invention

Therefore it is an object of the present invention to provide a vacuum pumping device, particularly of the turbomolecular type, that is compact and of small size.

In accordance with the present invention there is provided a vacuum pumping device which comprises a vacuum pump having a casing with a suction port and an exhaust port therein. The casing comprises a first portion and a second portion. The first portion houses gas pumping stages which are formed by rotor disks secured to a rotating shaft and stator rings secured to the casing. The second portion comprises an electric motor and at least one bearing for supporting the rotating shaft.

The vacuum pumping device also comprises an electronic control unit having a housing which forms an inner space therein. The housing comprises electronic components which are placed within the inner space. These electronic components form an electronic circuit for feeding the electric motor of the vacuum pump.

The second portion of the casing of the vacuum pump is placed within the inner space of the housing of the electronic control unit. The electronic components are disposed within the housing between an outer surface of the second portion of the casing and inner walls of the housing. The vacuum pumping device fan generates an air flow for cooling the electronic components and the second portion of the casing within the inner space of the housing.

The fan can be disposed outside or within the housing of the electronic control unit. If the fan is positioned outside the housing, the air flow generated by this fan is divided into two portions: one portion of the flow is directed toward the first portion of the casing, while another portion of the flow is directed towards the housing for cooling the electronic components. A liquid cooling system may be incorporated to the vacuum pumping device as an alternative to an air cooling system.

The electronic circuit comprises a sensor for sensing the temperature within the housing which is in a thermal contact with the second portion of the casing of the vacuum pump.

Further characteristics and advantages of the invention will become evident from the description of some preferred exemplary but not limiting embodiments of vacuum pumping devices illustrated in the attached drawings in which:

DETAILED DESCRIPTION

In the attached Figures the same reference numbers have been used to indicate equal or corresponding components.

With reference to FIGS. 3 to 7 the vacuum pumping device in accordance with the present invention comprises a substantially cylindrical turbomolecular vacuum pump 100 and an electronic control unit 1.

Figure 1:
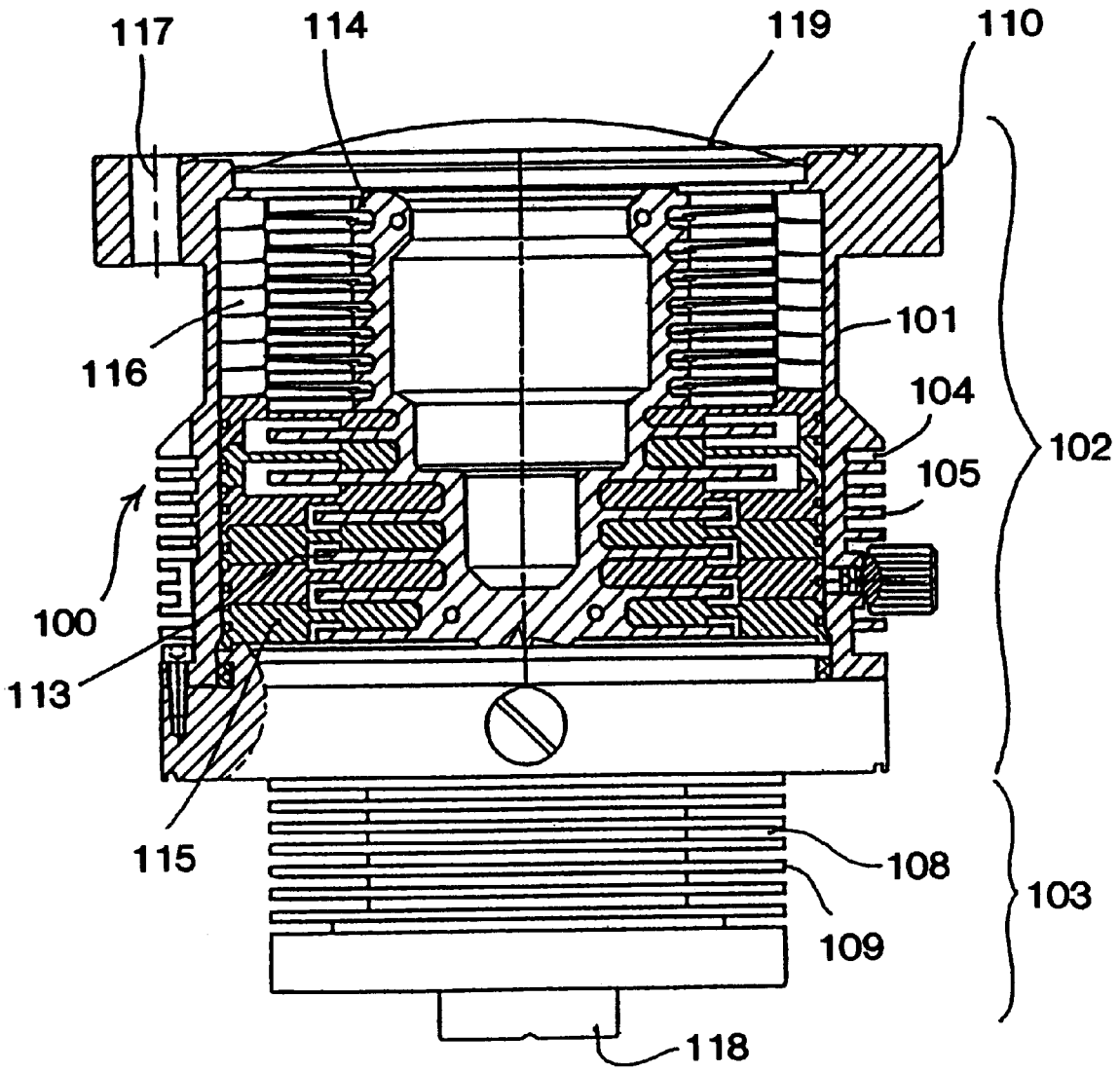
FIG. 1 is a partially cross sectioned front view of a turbomolecular vacuum pump.
Figure 2:
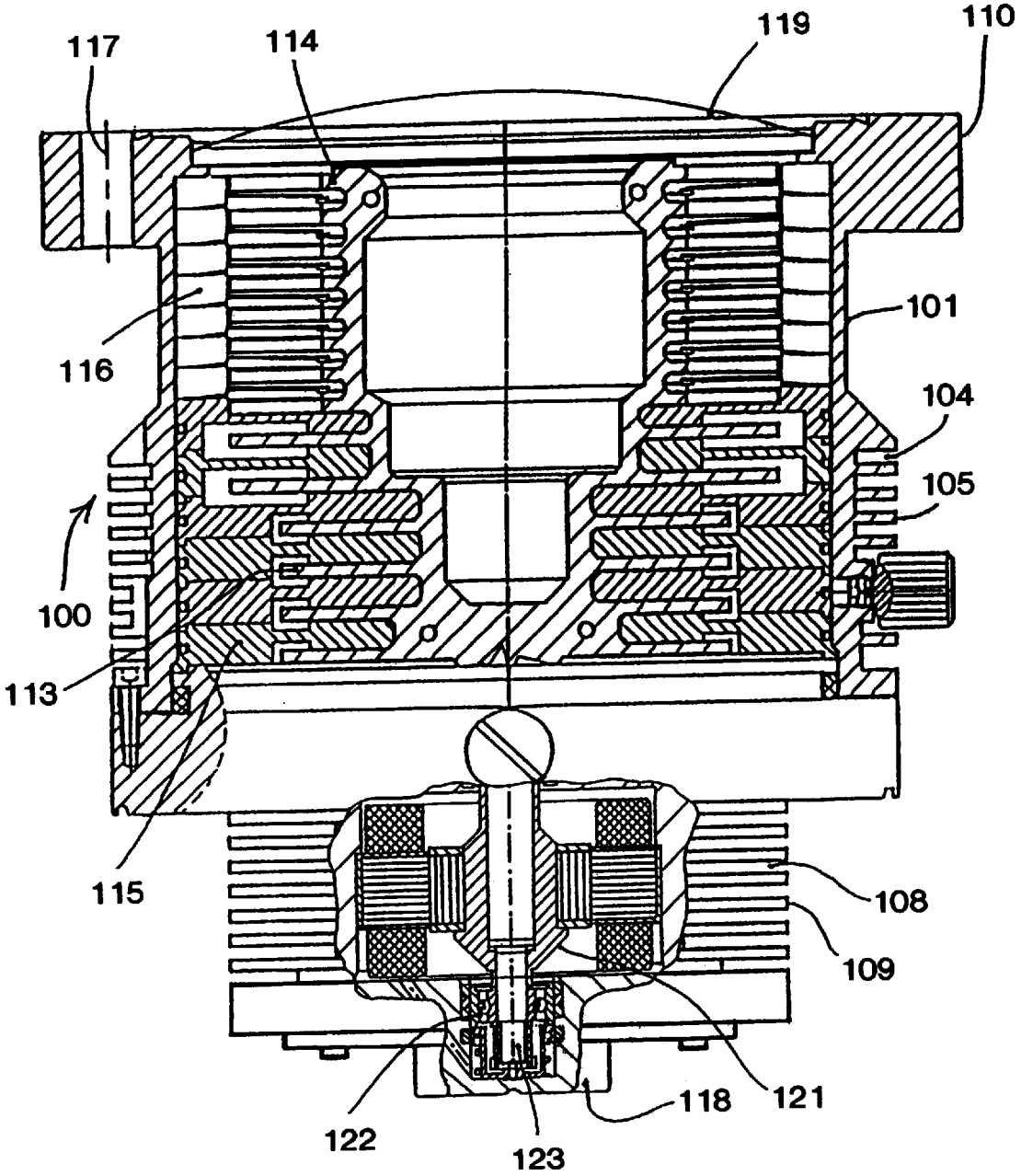
FIG. 2 is a front view of the vacuum pump of FIG. 1 showing the motor and the support bearing.

As better shown in FIGS. 1 and 2, the turbomolecular pump 100 comprises a substantially cylindrical casing 101, having a first portion 102 and a second portion 103, coaxial to the former and with a smaller cross section.

The first portion 102 houses the gas pumping stages, while the second portion 103 houses an electric motor 121 and a bearing 122 for supporting the rotatable shaft 123 of the turbomolecular pump 100.

Rotor disks 113 having flat surfaces and rotor disks 114 equipped with blades are mounted to the rotating shaft 123 of the turbomolecular pump 100, cooperating with stator rings 115 and 116, respectively, that are secured to the casing 101 of the turbomolecular pump 100 and forming with them gas pumping channels.

Figure 5:
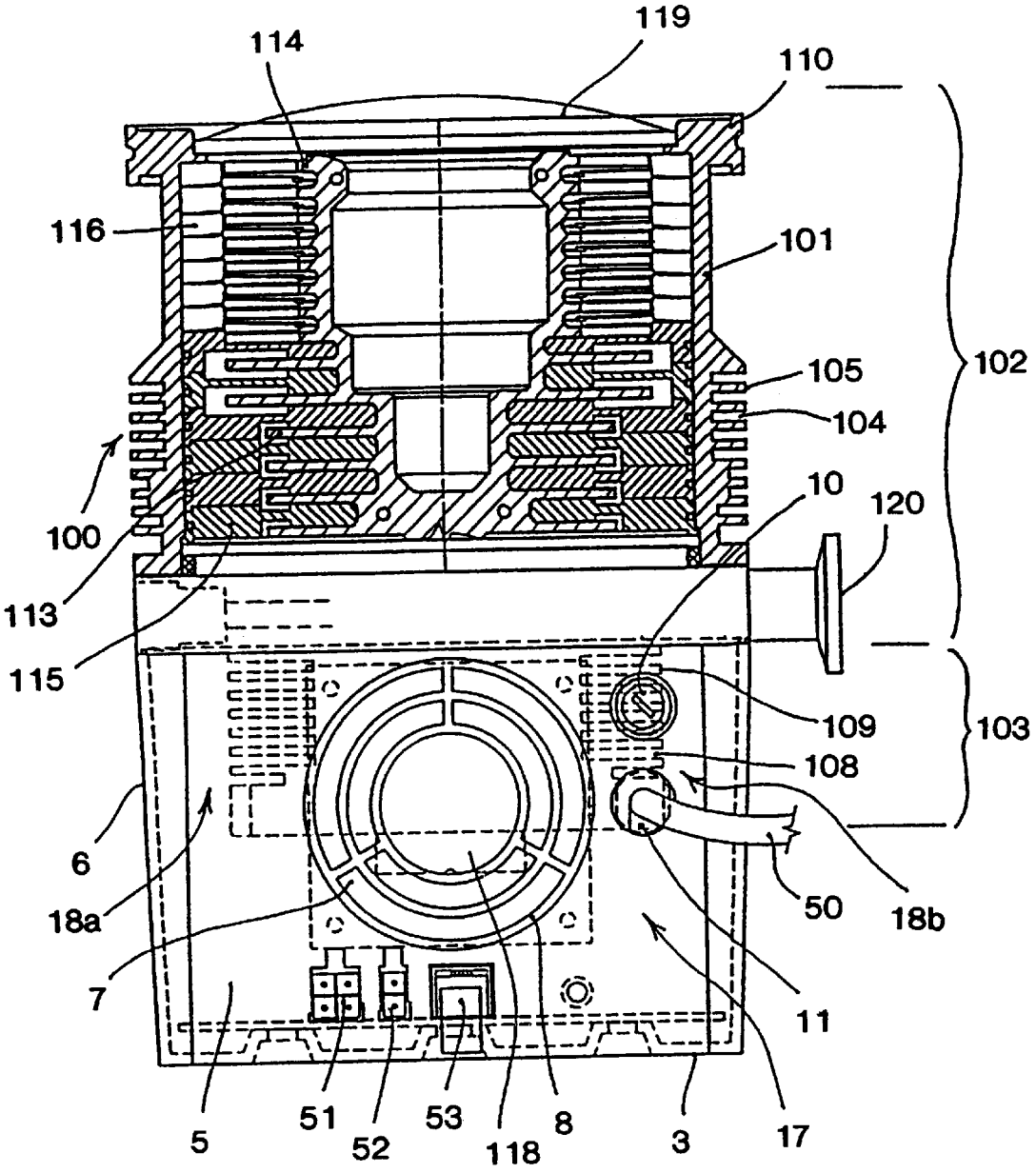
FIG. 5 is a rear partially cross sectioned view of the vacuum pumping device illustrated in FIGS. 2 and 3.

The casing 101 is further provided with an axial port 119 located at one end thereof for pumping the gases, and with a radial port 120 for exhausting the gases, located at the opposite end, this latter port being shown in FIG. 5.

A plurality of annular grooves 104 defining a series of cooling fins or rings 105 is provided on the outer surface of the first (cross-sectionally) larger portion 102 of the casing 101.

The turbomolecular pump 100 is further provided with an annular protruding ring or flange 110 with peripherally spaced holes 117 for securing the turbomolecular pump 100 to a vessel or chamber (not shown) in which vacuum is to be created.

A cylindrical extension 118 due to the presence within the turbomolecular pump 100 of a bearing and an electronic motor is provided on casing 101, at the opposite side with respect to the flange 110, in correspondence with a base of the second smaller portion 103.

Figure 3:
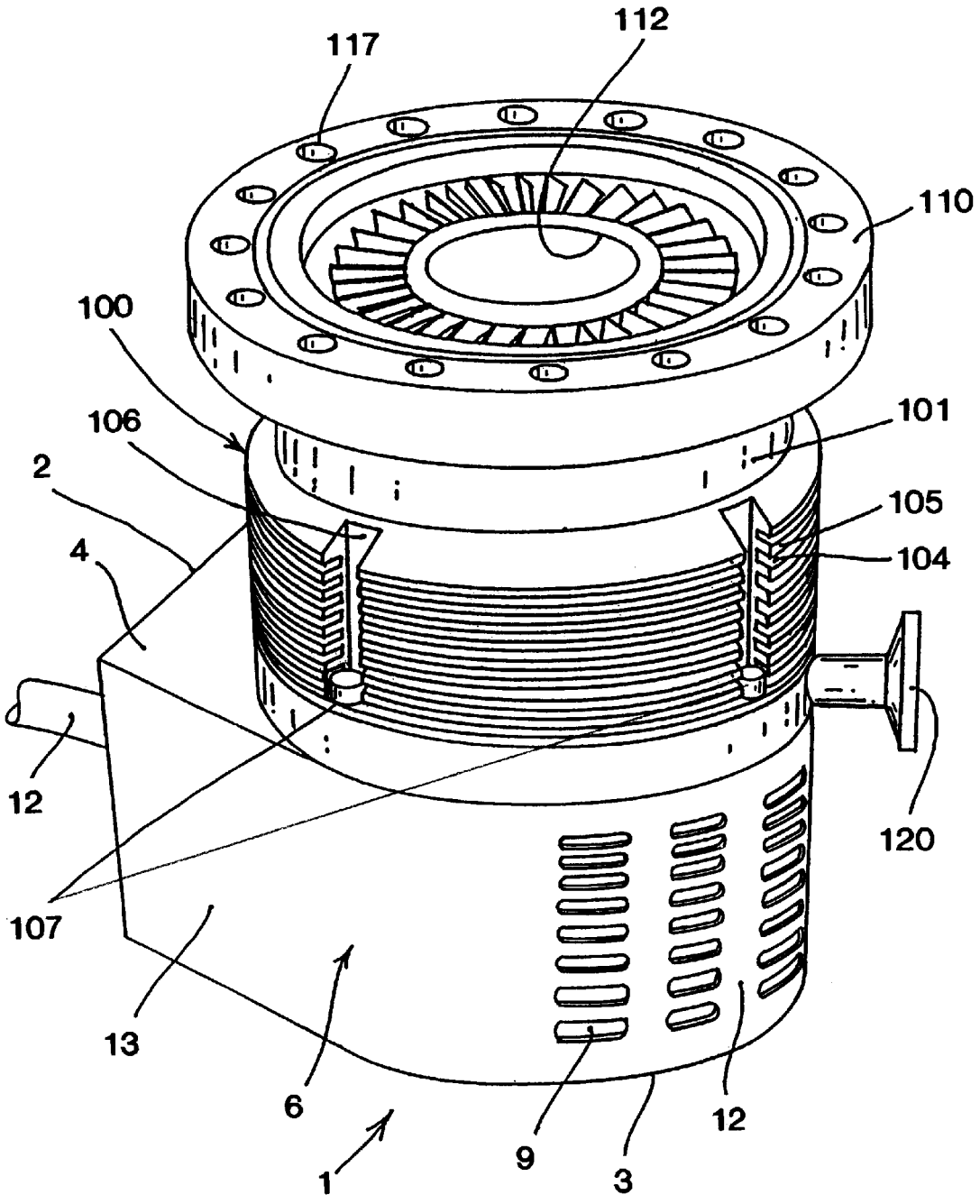
FIG. 3 is a perspective front view of the vacuum pumping device according to the present invention.
Figure 4:
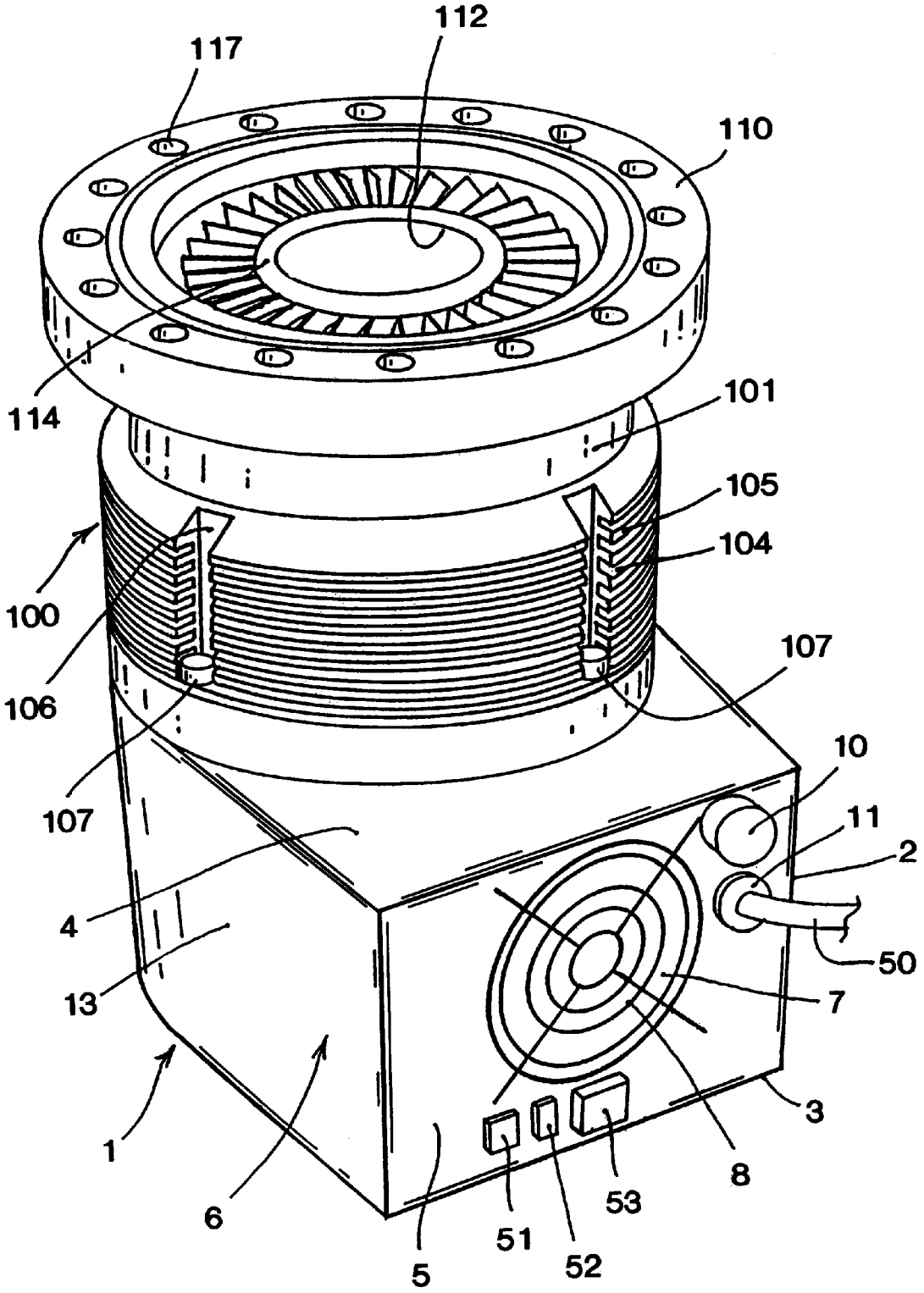
FIG. 4 is a rear perspective view of the pumping device of FIG. 3.

Additionally, as better shown in FIGS. 3 and 4, on the outer surface of the first larger portion 102 of the casing 101 there are formed three longitudinal grooves 106, spaced by 120° for allowing the passage of as many fastening screws 107 to secure the pump casing 101 to the control unit 1.

Annular grooves 108, defining a series of cooling rings 109 are provided on the outer surface of the second smaller portion 103 of the casing 101.

With reference again to FIGS. 3 to 7, the control unit 1 comprises a housing 2 forming an inner space 17 by a lower resting surface 3, an upper closure surface or cover 4, and side portions or sides 5 and 6.

The side 6 comprises a rounded portion 12 and two rectilinear or straight portions 13, substantially parallel to each other.

Figure 6:
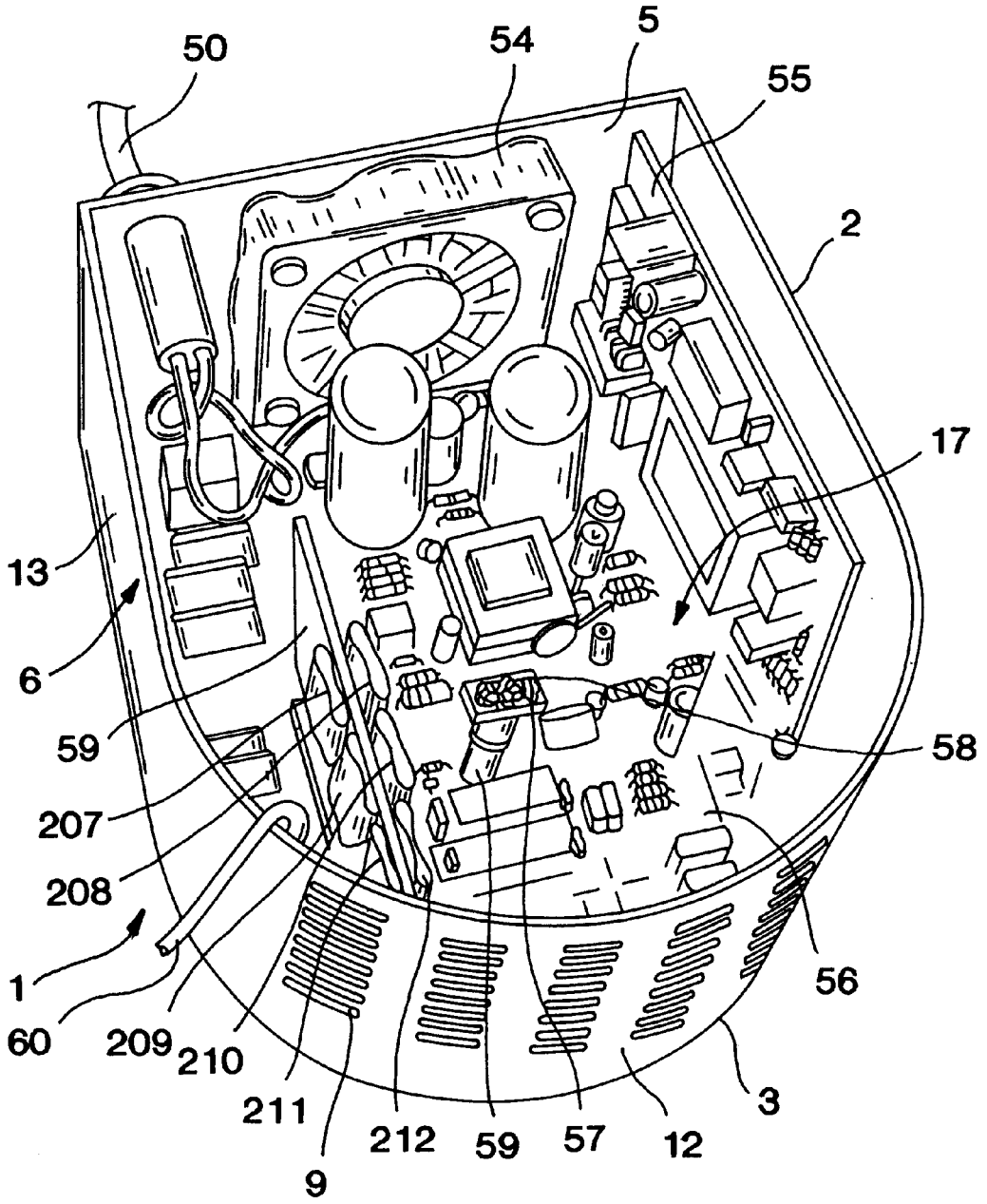
FIG. 6 is a perspective top view of an electronic control unit of a pumping device according to the present invention.

As shown in FIG. 6 in the inner space 17 of the housing 2 there are disposed the electronic components of an electronic circuit for generating a voltage system to feed an electric motor 121 of the turbomolecular pump 100, and for adjusting the level of the feeding voltage applied to the electric motor 121.

This circuit is fed through a plurality of leads 50 for the connection to the public power distribution network and comprises two main (printed circuit) boards 56 and 55, the first one being disposed on the bottom of the housing 2 and parallel to the lower resting surface 3, and the second one being adjacent and parallel to one of the straight portions 13 of the side 6.

In the side 5 there are further provided a removable plug 10 for accessing to a safety fuse (not shown), a sealing ring 11 for the passage of the supply cable 50 of the electronic control unit 1, and connectors 51, 52 and 53 for the exchange of communication and control signals between unit 1 and an external unit (not shown), if required.

Figure 7:
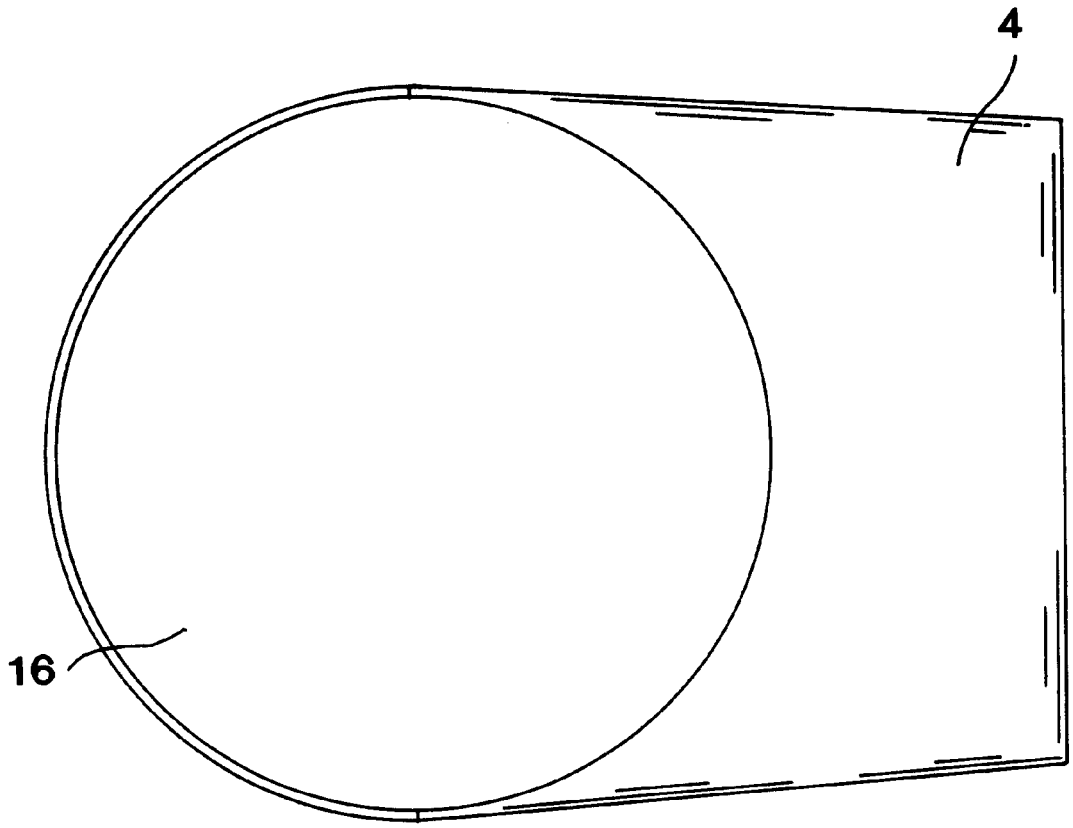
FIG. 7 is a plan view of the casing cover of the electronic control unit of FIG. 5.

As better shown in FIG. 7, the upper closure surface 4 is provided with a circular opening 16 allowing the passage of the second portion 103 of the cylindrical casing 101 into the inner space 17. The second portion 103 is therefore completely contained inside the space provided in the housing 2, while the first portion 102 of the cylindrical casing 101 is located outside the housing 2.

In the rounded portion 12 of the side 6 there are provided a plurality of slots 9 whereas on the substantially opposite side 5 of the housing 2 there is provided a large opening 7, covered by a net or grid 8. A cooling air flow enters the housing 2 through the plurality of slots 9, passes through the interior of the housing 2 and comes out through the opening 7.

The air flow for cooling the inner space of the housing 2 is generated by a cooling fan 54 located internally to the housing 2, in correspondence with the opening 7 in the side 5.

As better shown in FIG. 5, between the smaller second portion 103 of the casing 101 and inner walls of the housing 2 there are defined two symmetrical passages 18*a* and 18*b* for the cooling air flow entering through the plurality of slots 9 an in out through the opening 7.

In this symmetrical passage there are located the electronic components operating at the highest temperature of said electronic circuit, such as power transistors, microprocessors and transformers.

This way, since the second smaller portion 103 of the casing 101 is located in the same space 17 as the electronic components of the control unit 1, the air flow generated by a single cooling fan 54 cools at the same time the portion 103 and the "hottest" electronic components In said space 17 there is further provided a thermistor 57 for sensing the temperature of the electronic components in the control unit 1. The thermistor 57 is located substantially at the center of the lower circular opening 16 in the cover 4 through which the second portion 103 of the cylindrical casing 101 passes. The thermistor 57 is mounted on top of an upstanding post 59 on the board 56 parallel to the base of the housing 2 of the control unit 1.

Thus the surface of the thermistor 57 is in thermal contact with the cylindrical extension 118, when portion 103 of the turbomolecular pump 100 is inserted into the housing 2.

In order to improve the thermal contact between the surface of the thermistor 57 and the cylindrical extension 118, a resin layer 58 is interposed between the surface of the thermistor 57 and the cylindrical extension 118.

Since the portion of the pump casing in which the bearing 122 and the electric motor 121 are located is the portion at the highest temperature, the thermistor 57 can be used for detecting the maximum temperature of the vacuum pumping device and generating interruption control signals when a predetermined threshold of risk is reached.

By integrating the electronic control unit in the turbomolecular pump 100 the length of the leads 60 connecting the feeding electronic unit to the turbomolecular pump 100 is reduced to a minimum, while maintaining leads 60 entirely inside the housing 2.

In a preferred embodiment of the vacuum pumping device incorporating a three-phase A.C. asynchronous motor, the electronic circuit for generating the voltage system adapted to feed the electric motor 121 comprises a pair of transistors, one pair for each phase of the voltage system, directly connected to the main voltage and controlled by signals generated by gate driver circuits under the control of signals generated by a microprocessor.

In this kind of solution the adjustment of the feeding voltage value to that required by the motor 121 of the vacuum turbomolecular pump 100 can be achieved, for example, by superimposing an ON/OFF pulsating signal generated by the microprocessor, having a constant frequency and a duration capable of being modulated by pulse with modulation (PWM), to one or more control signals of the gate driver circuits.

This way the signals generated in the gate drivers for driving the transistors, are periodically interrupted in correspondence with the OFF states of the pulsating signal (PWM). Therefore the rms value of the voltage system feeding the electric motor 121 of the turbomolecular pump 100 is reduced proportionally to the duration of the OFF states of the pulsating signal (PWM).

According to an alternative embodiment of the vacuum pumping device of the invention, the electronic circuit for generating a voltage system for feeding the electric motor 121 can comprise a voltage transformer that converts the voltage value of the public distribution network into a value suitable for actuating the motor of the vacuum pump.

Suitable voltage regulators can be provided in this case to modify the level of the feeding voltage applied to the electric motor 121 of the vacuum pump 100.

Figure 8:
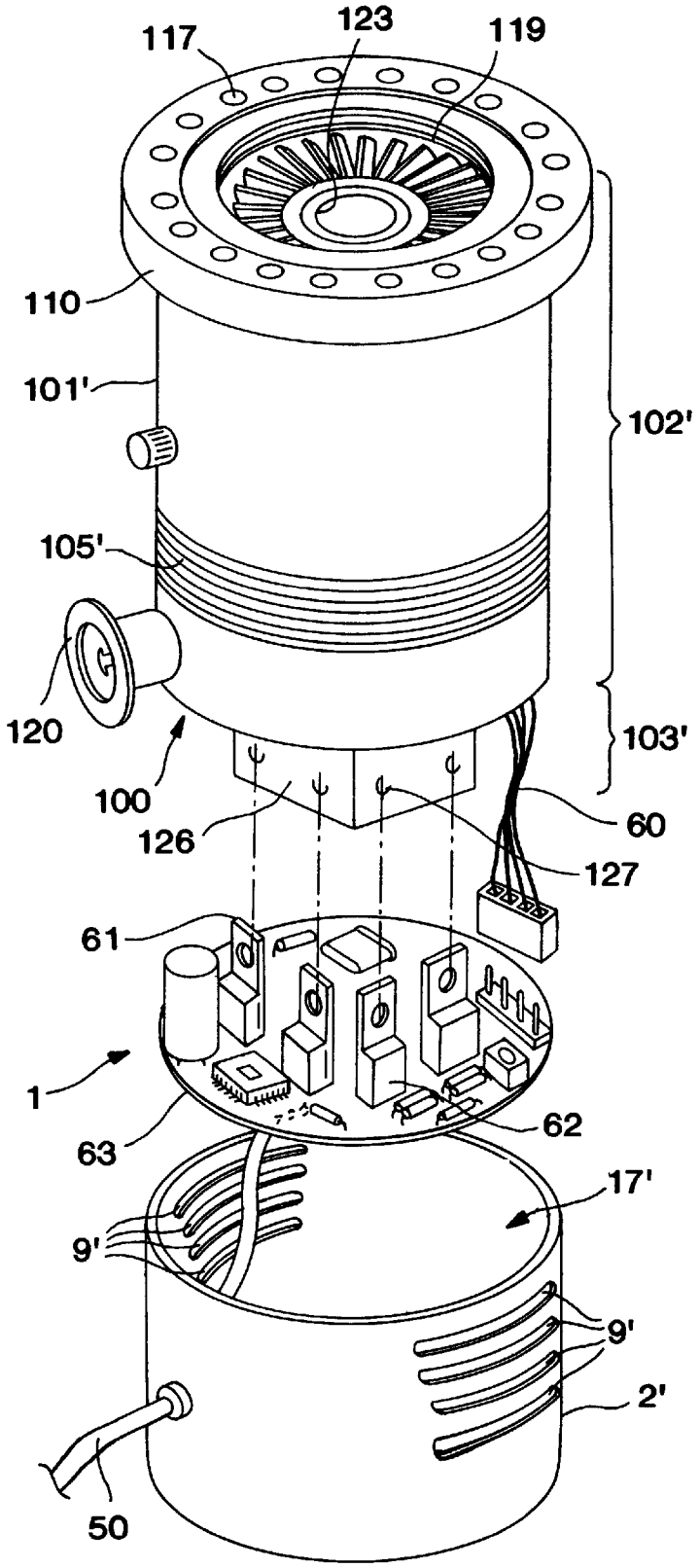
FIG. 8 is a schematic exploded view of one of the embodiments of the pumping device in accordance with the present invention.
Figure 9:
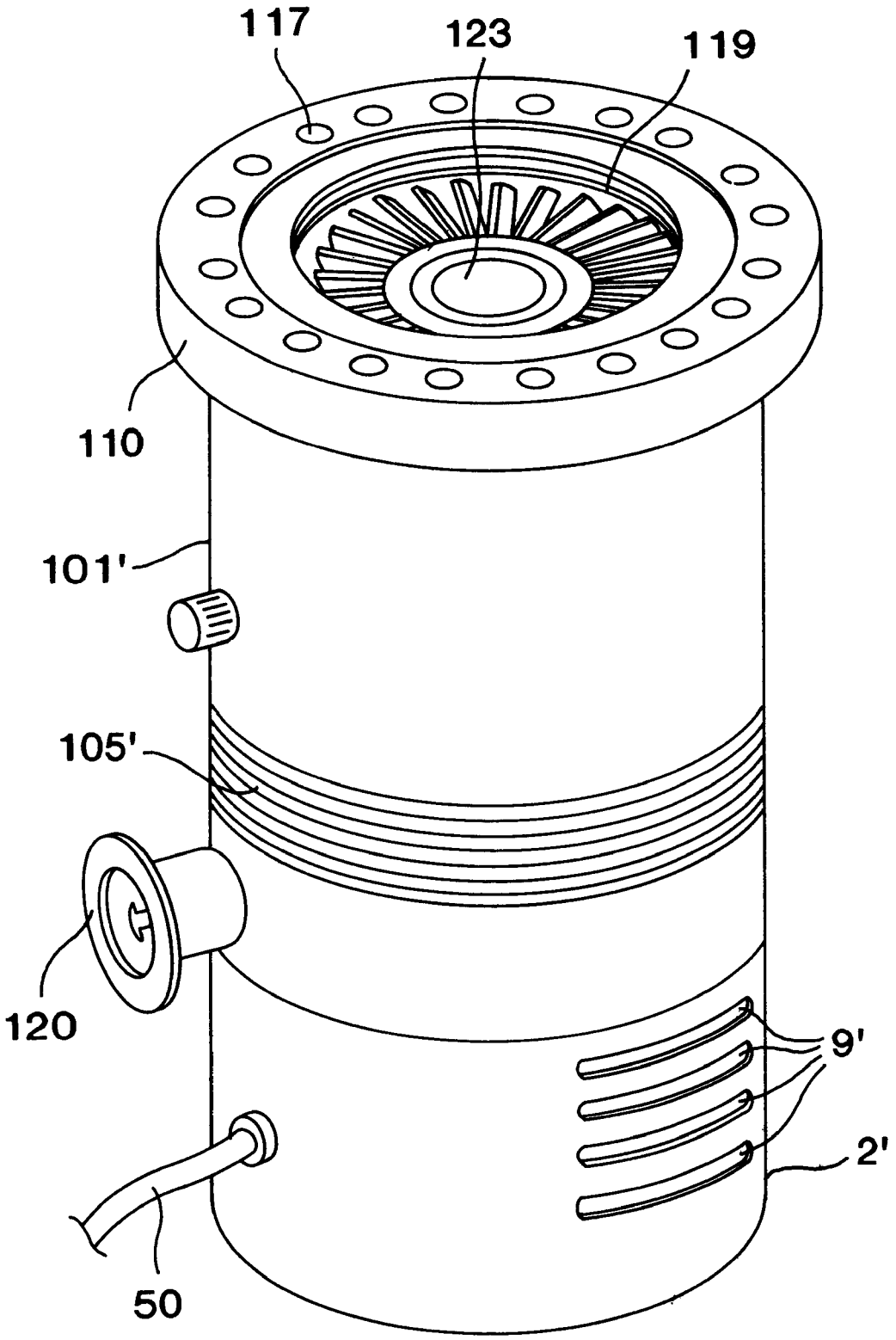
FIG. 9 is a schematic perspective view of the assembled pumping device of FIG. 8.

FIGS. 8 and 9 illustrate an embodiment of the pumping device according to the invention providing for a substantially prismatic shape of the smaller portion 103' of the casing 101' housing the bearing of the vacuum pump 100' and the electric motor of the vacuum pump.

On the lateral faces 126 of the portion 103' there are provided internally threaded holes 127 for fastening, through screws not shown in the Figures, heat sinks 61 that are in thermal contact relationship with the power components 62 of the electronic circuit that generates the voltage system feeding the electric motor of the vacuum pump 101'.

In this embodiment of such circuit, equipped with transistor pairs that are directly connected to the main voltage, the power electronic components 62 correspond to the power transistors, for example of the MOSFET type, driven by the gate drivers and directly connected to the main voltage.

The power components 62 are mounted on a circular board 63 that carries the other electronic components of the feeding circuit.

This circular board 63 and the smaller portion 103' of the casing 101' of the vacuum pump 100, are contained within an inner space 17' of a substantially cylindrical housing 2'.

The housing 2' is further provided with two diametrically opposite series of slots 9' for the air inlet and outlet.

The outer surface of the larger portion 102' of the casing 101' is further equipped with a plurality of annular grooves defining a series of cooling rings 105'.

The device described with reference to FIGS. 8 and 9 can be equipped with a cooling system using either air or a liquid as a refrigerating fluid.

Figure 10:
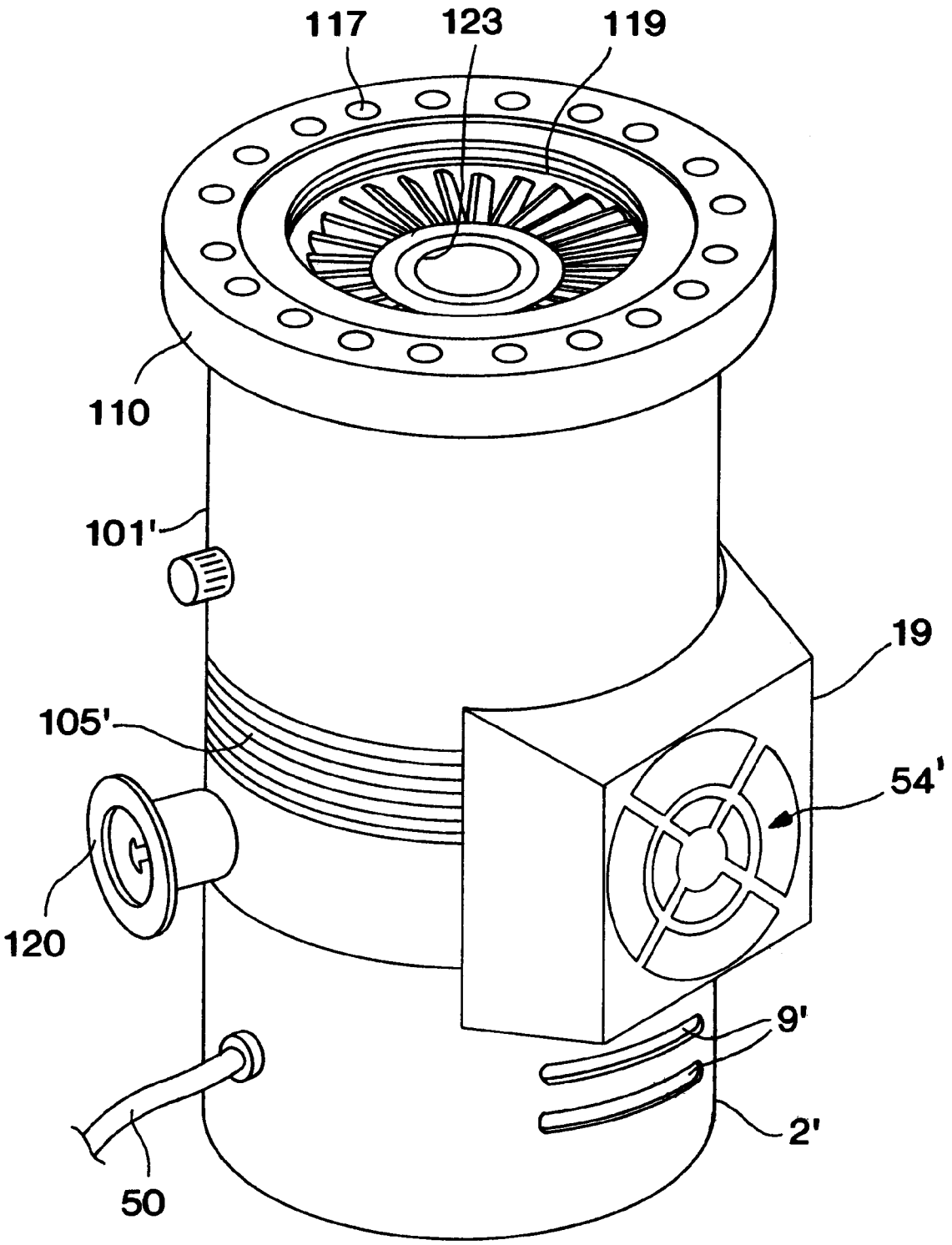
FIG. 10 is a schematic perspective view of the pumping device of FIG. 9 equipped with an air cooling system.

With reference to FIG. 10 a forced air flow cooling system is shown for the pumping device illustrated in FIGS. 8 and 9.

The forced air flow is generated by a fan 54' located outside the vacuum pumping device and positioned between the walls of a shroud t9,formed by a box-like polyhedral member fastened to a casing 101' of the pump 100'.

The shroud is fastened to the casing 101' and the two opposite bases thereof are open for the air inlet and outlet, so that one of the open bases is partially superimposed both on the larger portion 102' of the casing 101'—where the cooling rings 105' are located—on to the slots 9' of the housing 2' containing both the smaller portion 103' of the casing 101' of the vacuum pump 100' and the electronic components of the motor feeding circuit.

This way a part of the air flow caused by the fan 54' is directed toward the cooling rings 105' on the larger portion 102' of the vacuum pump 100' and another part is directed into the inner space 17' containing both the smaller portion 103' of the vacuum pump 100' and the electronic components of the electronic circuit generating the feeding voltage system.

This way, with a single fan 54' a flow of cooling air is obtained that cools both the inner space 17' of the vacuum pumping device and the portion 102' outside such space 17'.

Figure 11:
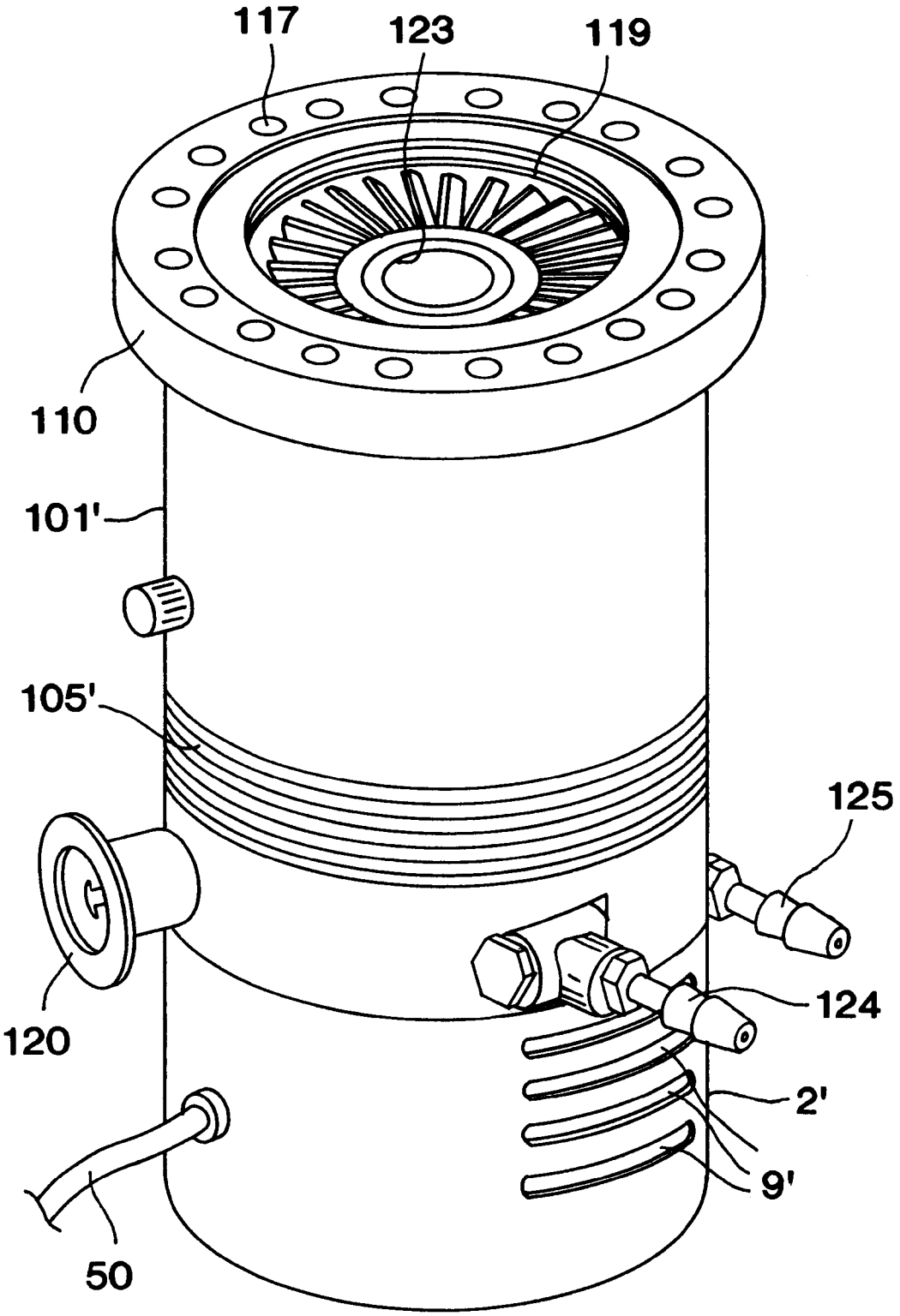
FIG. 11 is a schematic perspective view of the pumping device of FIG. 9 equipped with a liquid cooling system.

FIG. 11 illustrates a liquid cooling system of the pumping device shown in FIGS. 8 and 9.

In this embodiment a refrigerating liquid circulates along an annular channel, substantially coplanar with the rotor disks and formed within the wall of the portion 103' of the vacuum pump 100'. An inlet fitting 124 and an outlet fitting 125 are provided for connecting this annular channel to delivery and return ducts (not shown) of the cooling circuit.

Therefore, by exploiting the liquid cooling circuit in the body of the vacuum pump 100', it is possible to cool also the electronic components in the inner space 17', and more particularly to cool the power components 62 fastened to the heat sink 61 that are secured to the faces 126 of the smaller portion 103' of the casing 101'.

Figure 12:
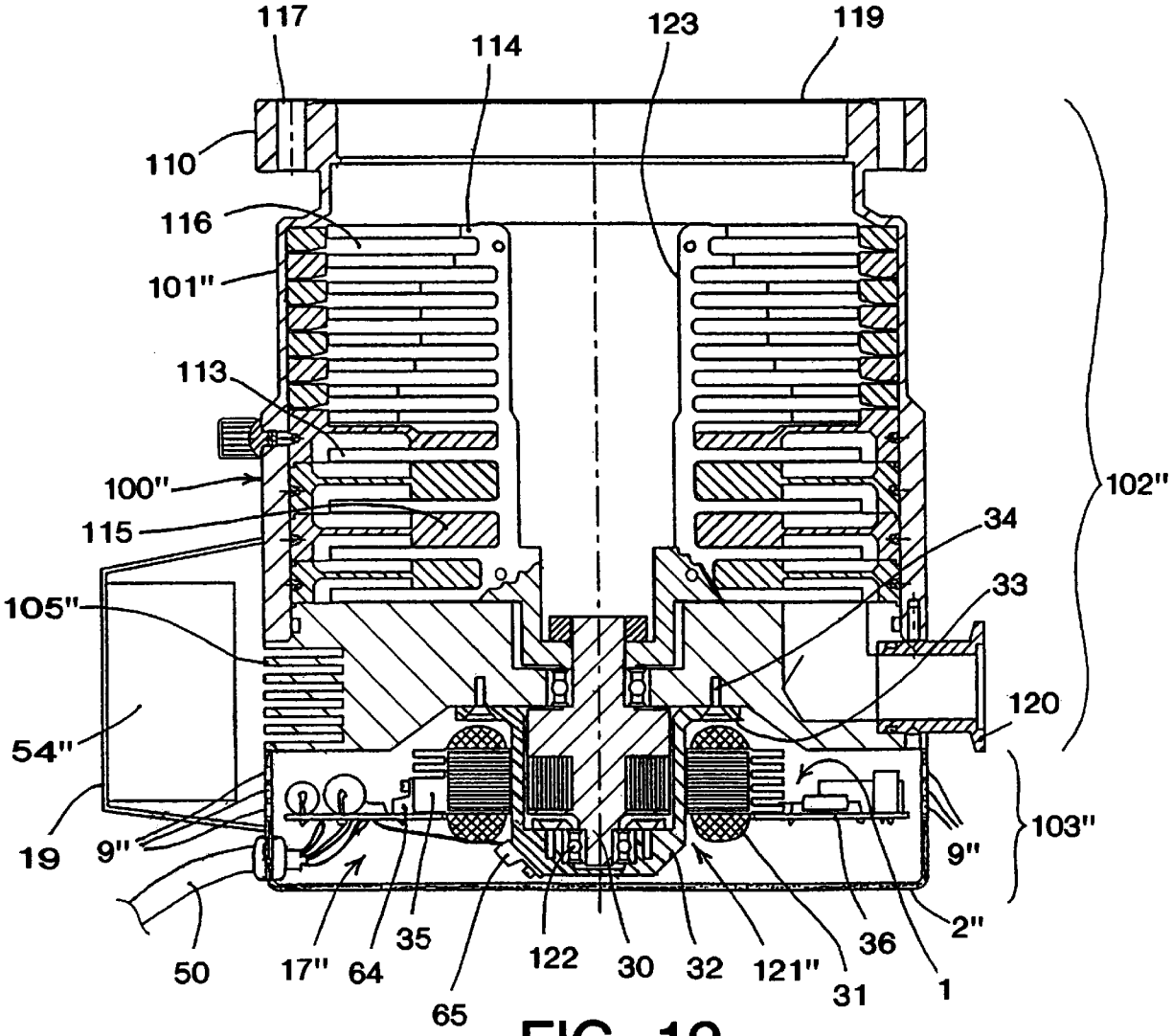
FIG. 12 is a cross sectional view of another embodiment of the vacuum pumping device according to the present invention equipped with an air cooling system.

FIG. 12 illustrates another embodiment of the pumping device according to the present invention wherein the electric motor 121" of the vacuum pump 100" comprises a rotor 30 and a stator 31 separated by a cup-shaped casing 32 having an outwardly folded rim for securing the cup-shaped casing 32 to the body of the vacuum pump by means of screws 34.

In addition to the electric motor 121" of the vacuum pump 100", inside the cup-shaped casing 32 there is located a bearing 122 for supporting the rotor 30 of the electric motor 121".

In this embodiment, the casing 101" of the vacuum pump 100" has a first (cross-sectionally) larger portion 102" and a second (cross-sectionally) smaller portion 103", this latter substantially corresponding to the cup-shaped casing 32 disposed between the rotor 30 and the stator 31 of the motor 121" of the vacuum pump 100".

In this embodiment the stator 31 of the electric motor 121" is located outside the space of the pumping device maintained under vacuum and can be subjected to more effective cooling, e.g. by disposing a heat sink 35 about the stator 31.

A circular board 36 provided with a central bore and mounting the electronic components of the motor feeding circuit of the vacuum pump 100", is secured to the base of the heat sink 35.

Still with reference to FIG. 12, the smaller portion 103" of the casing 101" of the vacuum pump 100", is disposed within the space 17" defined inside a housing 2" having a substantially cylindrical shape.

This housing 2" is further equipped with aerating slots 9" for allowing the passage of an air flow generated by a fan 54" disposed outside of the housing 2", and located within a shroud 19.

The shroud 19 has opposite bases that are open for allowing the air inlet and outlet, and the shroud is preferably secured to the casing 101" so that one of the open bases is partially superimposed on the larger portion 102", of the casing 101" where the cooling rings 105" are located, and is partially superimposed on the slots 9" of the housing 2" containing both the smaller portion 103" of the casing 101" and the electronic components of the feeding circuit.

This way the air flow generated by the fan 54" is partially directed towards the larger portion 102" of the vacuum pump 100", and partially towards the inner space 17" containing both the smaller portion 103" of the vacuum pump 100" and the electronic components of the electronic circuit for generating the voltage system feeding the electric motor.

Advantageously the temperature inside the space 17", can be controlled through a pair of thermistors 64 and 65 that are in thermal contact with the heat sink 35 and the cup-shaped casing 32, respectively.

Figure 13:
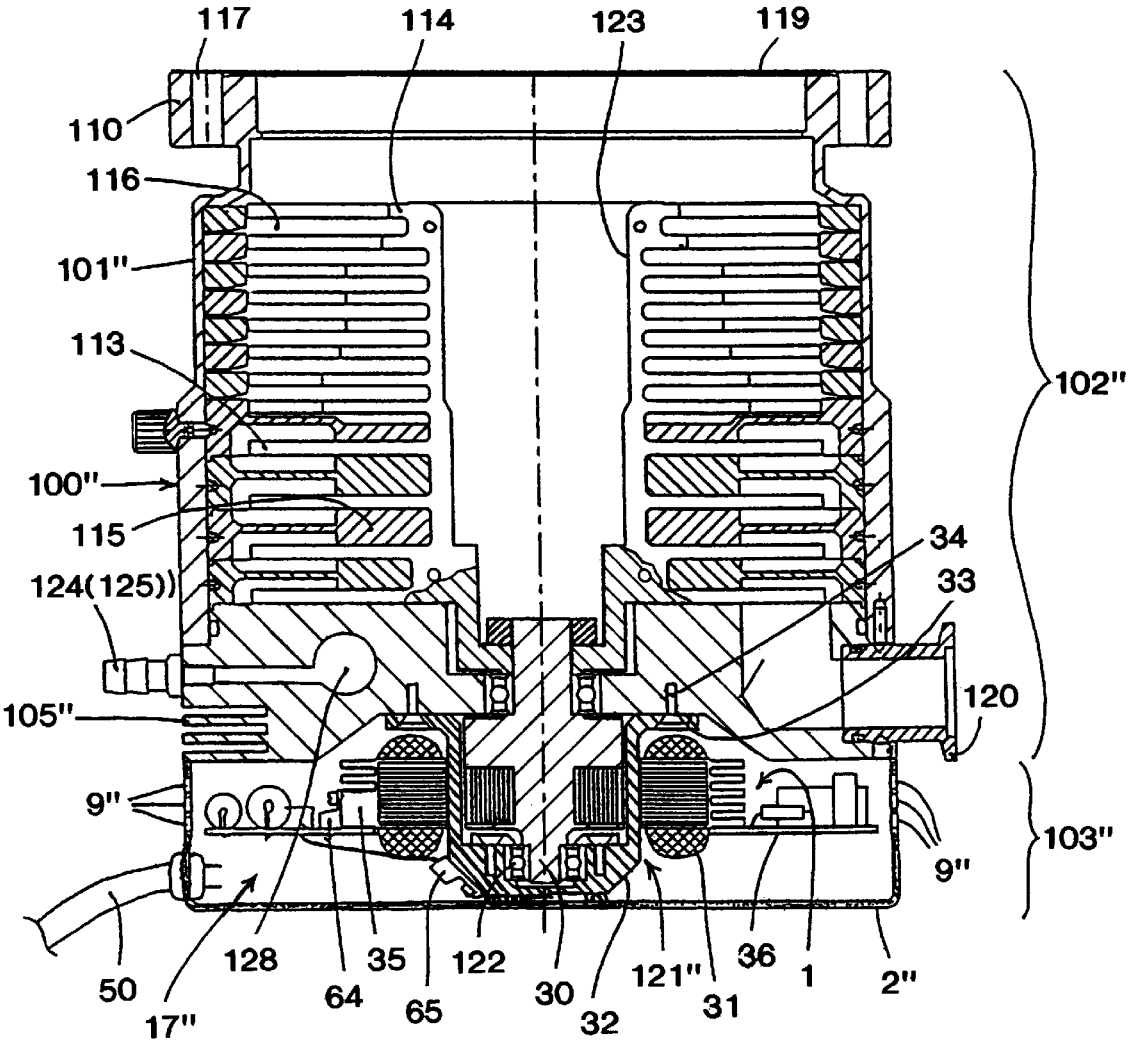
FIG. 13 is a cross sectional view of the embodiment shown in FIG. 12 of the vacuum pumping device according to the present invention equipped with a liquid cooling system instead of the air cooling system.

FIG. 13 illustrates the embodiment of the pumping device according to the invention as described with reference to FIG. 12, in which the vacuum pumping device is cooled through a liquid flow instead of an air flow.

Similarly to the example described with reference to FIG. 11, through inlet and outlet fittings 124 and 125 the coolant liquid is admitted into an annular channel 128, substantially coplanar with the rotor disks and provided in the portion 103' of the vacuum pump 100".

This way, by exploiting the liquid cooling circuit in the body of the vacuum pump 100" it is possible to cool also the electronic components in the inner space 17".

Figure 14:
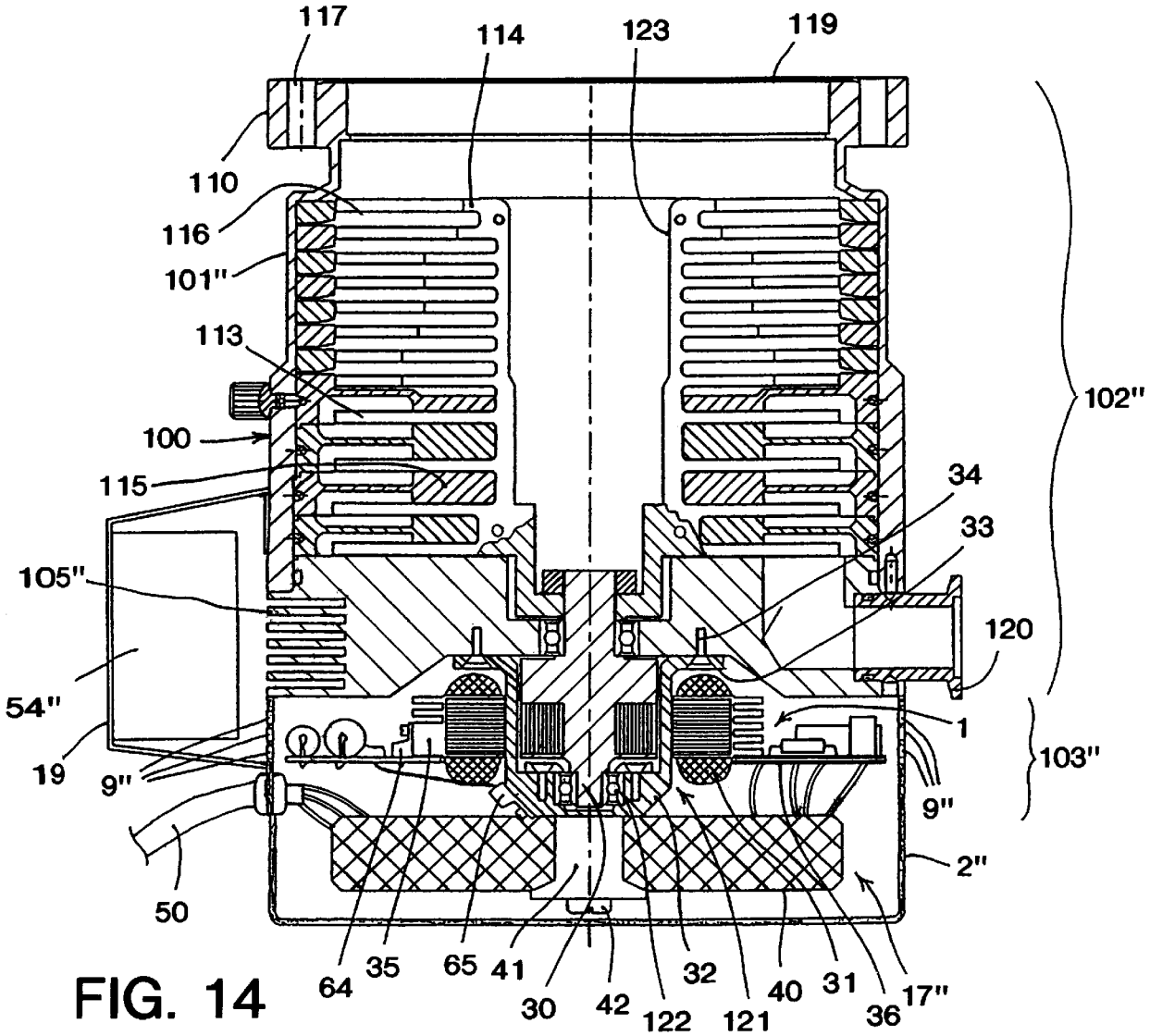
FIG. 14 is a cross sectional view of yet another embodiment of the vacuum pumping device according to the present invention equipped with an air cooling system.
Figure 15:
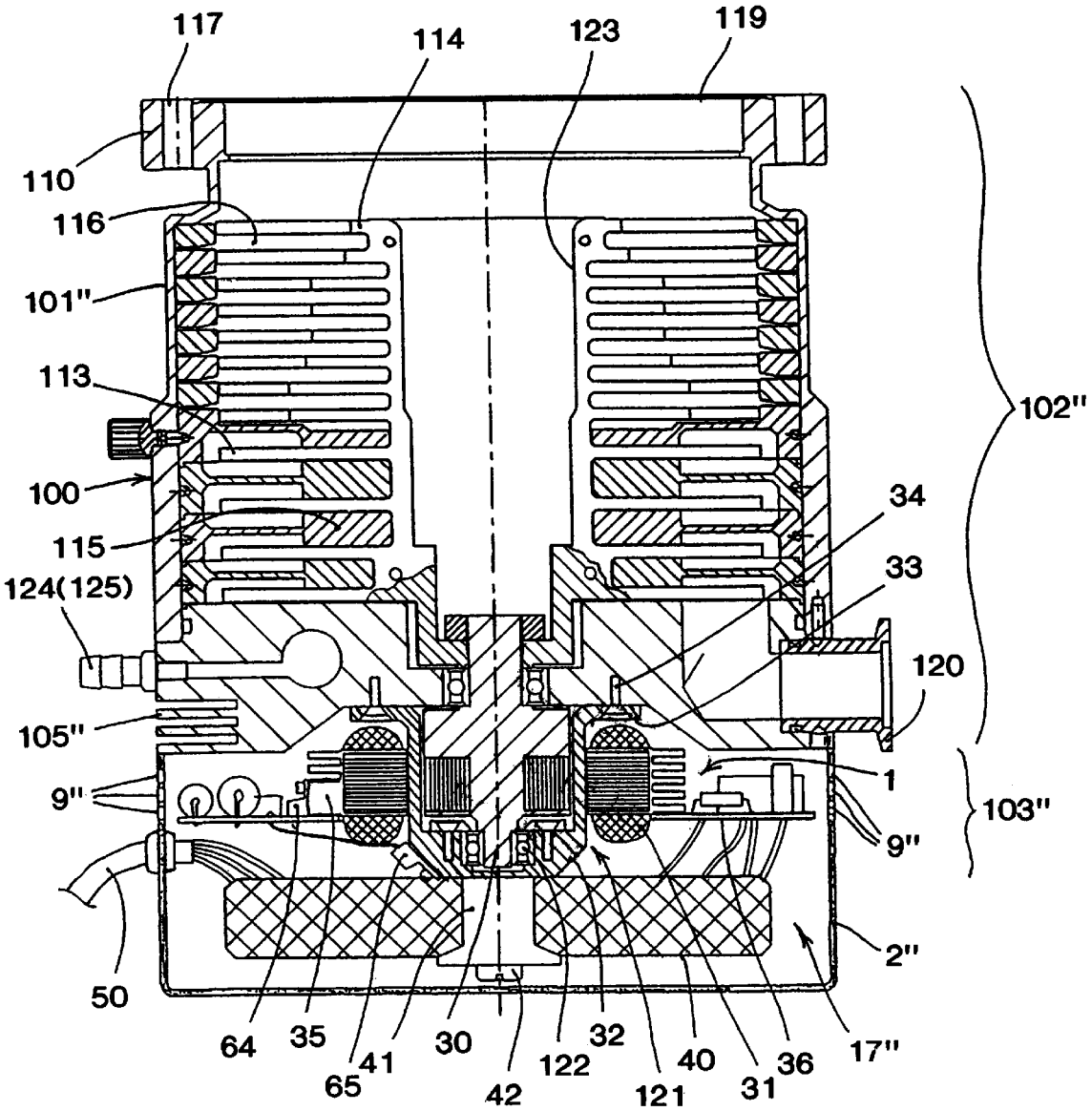
FIG. 15 is a cross sectional view of a third embodiment of the pumping device according to the invention equipped with a liquid cooling system.

FIGS. 14 and 15 illustrate further embodiments of the pumping devices according to the invention in which the coolant of the vacuum pumping device is an air or a liquid, respectively. The devices are those illustrated in FIGS. 12 and 13, respectively, and are equipped with an electronic circuit for generating a voltage system capable of feeding the electric motor of the vacuum pump and comprising a toroidal voltage transformer 40.

The transformer 40 is located inside the housing 2", in the same inner space 17" containing the remaining electronic components of the feeding circuit.

The transformer 40 is located between the base of the housing 2 and the smaller portion 103" of the casing 101" of the vacuum pump 100".

Moreover, the transformer 40 is fixed to the body of the vacuum pump 100" by means of a sleeve 41 that is retained by a screw 42 against the base of the cup-shaped casing 32.

From the above description of preferred embodiments of the present invention it is evident that the problem of achieving a vacuum pumping device that is compact and of small size has been advantageously solved and without prejudice of the optimum working condition of the device due to an undesired increase of the temperature of the mechanical and electronic components of the device.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A vacuum pumping device comprising:

a vacuum pump having a casing with a suction port and an exhaust port therein;

said casing comprising a first portion and a second portion;

said first portion comprising gas pumping stages formed by rotor disks secured to a rotating shaft, and stator rings secured to said casing;

said second portion comprising an electric motor and at least one bearing for supporting said rotating shaft;

an electronic control unit having a housing;

said housing comprising electronic components placed within an inner space of said housing and forming an electronic circuit for feeding said electric motor of said vacuum pump; and said second portion of said casing of said vacuum pump being placed within said inner space of said housing of said electronic control unit.

2. The vacuum pumping device of claim 1, further comprising a cooling device for generating an air flow for cooling said electronic components and said second portion of said casing within said inner space of said housing.

3. The vacuum pumping device of claim 2, wherein said housing of said electronic control unit comprises a flat side wall and a sidewall which has a pair of flat portions with a rounded portion therebetween arranged so that said round portion opposes said flat side wall, and said housing has a substantially semicircular cross-section in a horizontal plane.

4. The vacuum pumping device of claim 2, wherein said housing of said electronic control unit has a substantially cylindrical shape.

5. The vacuum pumping device of claim 3, wherein said rounded portion of said side wall of said housing comprises a plurality of slots, and said flat side wall of said housing comprises an opening for passing said cooling air flow from said cooling device through said plurality of slots in said rounded portion and said opening in said side wall.

6. The vacuum pumping device of claim 5, wherein said cooling device is a fan that is disposed outside said housing of said electronic control unit.

7. The vacuum pumping device of claim 5, wherein said cooling device is a fan, which is disposed within said housing of said electronic control unit.

8. The vacuum pumping device of claim 6, wherein said casing of said vacuum pump comprises a shroud fastened thereto, and said fan is disposed within said shroud so that a portion of the air flow generated by said fan is directed toward said first portion of said casing, while another portion of the air flow is directed toward said housing of said electronic control unit for cooling said electronic components therein.

9. A vacuum pumping device comprising:

a vacuum pump having a casing with gas inlet and gas exhaust ports, said casing being formed by a first portion and a second portion, a cross section of said first portion being substantially larger than a cross section of said second portion;

a plurality of vacuum pumping stages disposed within said first portion of said casing between said inlet and exhaust ports, each said pumping stage comprising a rotor and a stator respectively secured to a rotating shaft and said casing;

an electric motor for rotating said shaft and a bearing assembly for supporting said rotating shaft disposed within said second portion of said casing;

an electronic control unit comprising a housing with an electronic circuit for feeding said electric motor, said second portion of said casing being disposed within an interior of said housing; and an air cooling device for generating an air flow for cooling said interior of said housing.

10. The vacuum pumping device of claim 9, wherein said housing of said electronic control unit comprises an upper closure with an opening therein for installation of said second portion into said housing, a lower closure and side walls, a space between side walls of said second portion and said side walls of said housing defining passages for said flow of the cooling air.

11. The vacuum pumping device of claim 10, wherein said electronic circuit for feeding said electric motor is disposed in said space between said side walls of said housing and said side walls of said second portion.

12. The vacuum pumping device of claim 11, wherein said electronic circuit comprises a sensor for sensing the temperature within said housing, and said sensor is in thermal contact with said second portion.

13. The vacuum pumping device of claim 12, wherein said second portion further comprises a cylindrical extension, and said temperature sensor is in thermal contact with said cylindrical extension via a layer of material having substantial thermal conductivity.

14. The vacuum pumping device of claim 13, wherein said temperature sensor is mounted on a post which is attached to a board which is disposed adjacent to said lower closure of said housing and is parallel thereto.

15. The vacuum pumping device of claim 14, wherein said layer of material is made of resin.

16. A vacuum pumping device comprising:

a vacuum pump having a casing, said casing being formed by a first portion and a second portion, a cross section of said first portion being substantially larger than a cross section of said second portion;

said second portion comprising a plurality of cooling rings formed by annular grooves on an outer surface of said second portion;

a plurality of vacuum pumping stages disposed within said first portion, each said pumping stage comprising a rotor and a stator respectively secured to a rotating shaft and said casing;

an electric motor for rotating said shaft and a bearing assembly for supporting said rotating shaft disposed within said second chamber of said casing;

an electronic control unit comprising a housing with electronic components therein, said components forming an electronic circuit for feeding said electric motor, at least said second portion of said casing being disposed within an interior of said housing, said electronic components being disposed between said outer surface of said second portion and inner walls of said housing; and a cooling device for cooling said interior of said housing.

17. The vacuum pumping device of claim 16, wherein said electronic control unit further comprises feeding leads for connecting said electronic circuit to said electric motor, and said feeding leads are entirely contained within said housing when said second portion is disposed within said housing.

18. The vacuum pumping device of claim 17, wherein said electronic control unit further comprises a voltage transformer, and said transformer is disposed between a base of said housing and said second portion.

19. The vacuum pumping device of claim 18, wherein said cooling device is a fan, and said fan generates an air flow for passing through a passage formed between an outer surface of said second portion and inner walls of said housing.

20. The vacuum pumping device of claim 18, wherein said cooling device is a liquid cooling system.

21. The vacuum pumping device of claim 19, wherein said vacuum pump is a turbomolecular vacuum pump.

* * * * *